US007268294B2

(12) United States Patent
Ohkawa et al.

(10) Patent No.: US 7,268,294 B2
(45) Date of Patent: Sep. 11, 2007

(54) ADAPTOR; CONTROLLER AND PLUG RECEPTACLE FOR ELECTRONIC DEVICE

(75) Inventors: Kiichi Ohkawa, Oyama (JP); Kazunori Adachi, Oyama (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/093,038

(22) Filed: Mar. 7, 2003

(65) Prior Publication Data

US 2003/0045170 A1 Mar. 6, 2003

(30) Foreign Application Priority Data

Sep. 5, 2001 (JP) ..... 2001-268145

(51) Int. Cl.
*H01H 9/02* (2006.01)
*H01R 25/00* (2006.01)

(52) U.S. Cl. ..... 174/53; 174/520; 340/870.02; 439/638

(58) Field of Classification Search ..... 174/53, 174/66, 50, 57, 58, 520; 711/100; 348/473; 340/870.02; 455/11.1; 379/88.021, 88.02, 379/37, 29.11, 29.1, 29.09, 41; 358/401; 350/438; 220/3.2, 3.3, 3.8, 3.9, 4.02; 361/600, 361/601, 641, 45; 370/438; 439/120, 435, 439/436, 949, 638

See application file for complete search history.

(56) References Cited

U.S. PATENT DOCUMENTS 3,725,850 A * 4/1973 Izumi ..... 439/359
4,595,894 A * 6/1986 Doyle et al. ..... 361/601
4,802,052 A * 1/1989 Brant et al. ..... 361/45
5,260,795 A * 11/1993 Sakai et al. ..... 348/231.4
5,418,328 A * 5/1995 Nadeau ..... 439/120
5,485,356 A * 1/1996 Nguyen ..... 174/66
5,657,254 A * 8/1997 Sierk et al. ..... 702/98
5,745,620 A * 4/1998 Bergmann ..... 385/56
5,801,635 A * 9/1998 Price ..... 340/656
5,909,480 A * 6/1999 Reynaud et al. ..... 379/15.01
6,104,909 A * 8/2000 Baldwin et al. ..... 455/425
7,034,224 B2 * 4/2006 Kim et al. ..... 174/50

FOREIGN PATENT DOCUMENTS

| | | |
|---|---|---|
| JP | 06-210067 | 8/1994 |
| JP | 06210067 | 8/1994 |
| JP | 06-75098 | 10/1994 |
| JP | 09160633 | 6/1997 |
| JP | 09223286 | 8/1997 |
| JP | 10341249 | 12/1998 |
| JP | 11196481 | 7/1999 |
| JP | 2000151657 | 5/2000 |
| JP | 2001007743 | 1/2001 |
| JP | 2001007863 | 1/2001 |

* cited by examiner

*Primary Examiner*—Angel R. Estrada
(74) *Attorney, Agent, or Firm*—Katten Muchin Rosenman LLP

(57) ABSTRACT

In a system which includes adaptors a controller and plug receptacles connected to electronic devices, an adaptor that can store identification information about electronic devices is connected to an electronic device, and the plug receptacle side to which the electronic device is connected transmits to the power line its own identification information, etc. in coordination with the identification information of electronic devices from the adaptor. The controller receives this information and keeps track of locations of the electronic devices.

12 Claims, 4 Drawing Sheets

| INTERFACE UNIT IDENTIFICATION INFORMATION | ELECTRONIC DEVICE IDENTIFICATION INFORMATION |
|---|---|
| 45 | 01001 |
| 46 | |
| 47 | |
FIG. 5
| PLUG RECEPTACLE IDENTIFICATION INFORMATION | XXX | |
|---|---|---|
| PLUG RECEPTACLE POSITION INFORMATION | 2F; ROOM03 | |
| INTERFACE UNIT POSITION INFORMATION | 45 | (1, 1) |
| | 46 | (2, 1) |
| | 47 | (3, 1) |
FIG. 6
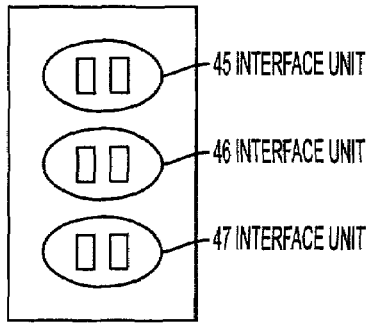
FIG. 7A
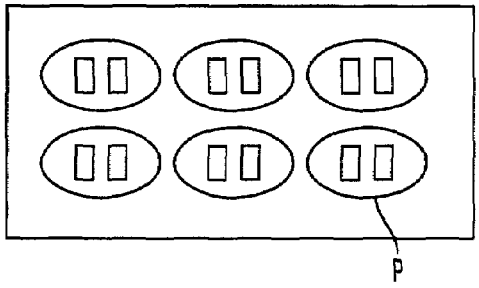
FIG. 7B

| PLUG RECEPTACLE IDENTIFICATION INFORMATION | XXX | |
|---|---|---|
| PLUG RECEPTACLE POSITION INFORMATION | 2F; ROOM03 | |
| ELECTRONIC DEVICE POSITION INFORMATION | 45 (1, 1) | 01001 |
| | 46 (2, 1) | - |
| | 47 (3, 1) | - |

| INTERFACE IDENTIFICATION INFORMATION | ELECTRONIC DEVICE IDENTIFICATION INFORMATION |
|---|---|
| 45 | 01001 |
| 46 | |
| 47 | |

| SYSTEM TYPE = SYSTEM A | |
|---|---|
| INTERFACE IDENTIFICATION INFORMATION | ELECTRONIC DEVICE IDENTIFICATION INFORMATION |
| 45 | 10011 |
| 46 | 00111 |
| 47 | 01011 |

ADAPTOR; CONTROLLER AND PLUG RECEPTACLE FOR ELECTRONIC DEVICE

BACKGROUND OF THE INVENTION

1. Field of the Invention

This invention relates to a system that keeps track of the location of various electronic devices using AC lines (power lines), and various devices used in the system, including adaptors, controllers, and plug receptacles.

2. Description of the Prior Art

The idea of communicating using AC lines (power lines) is already known (see unexamined patent H10-341249 [1998]). The idea is also already known to provided within amusement devices a trouble information collection device that collects error information and other trouble information, a coin information collection device that collects information about sales, and a power line modem that superimposes on the power lines within the facility, as data, the collected trouble information, sales information, and other information within the device, and to have a central controller that collects data from power lines within the facility via a power line modem and controls the amusement devices (see unexamined patent H6-210067 [1994]).

However, in controlling electronic devices of many different types, there is the problem that their arrangement position and storage position cannot be managed efficiently.

That is, although internal information for each amusement device can be reported to a collection device by connecting amusement devices to the power line, one cannot obtain such information as where an amusement device is located.

SUMMARY OF THE INVENTION

It is an object of the present invention to efficiently keep track of the location of electronic devices using power lines.

This and other objects of the present invention are attained by an electronic system comprising an electronic device; and adaptor; and a plug receptacle, said adaptor forming a connection part to form an electricity supply path from said plug receptacle to said electronic device, said connection part being detachably-attached to said delectronic device and to said plug receptacle, wherein the adaptor comprises memory means storing identification information about the electronic device; and transmission means transmitting said identification information stored in said memory means to a side of said plug receptacle.

The adaptor may be built into the connection part or may be detachably-attached to the connection part.

The adaptor may include an operation unit, memory means that stores connection destination plug receptacle information about said electronic device, detection means that detects that the supply of electricity from said plug receptacle has stopped or that an oeration has been made on the operation unit, and display means that, upon said detection, displays said connection destination plug receptacle information stored in said memory means.

In an electronic system comprising a plurality of electronic devices; a plurality of adaptors; a plurality of plug receptacle and a controller, the controller may include reception means that receives, from each plug receptacle, identification information about the electronic device that is connected to the plug receptacle and identification information about said plug receptacle, a memory means that stores identification information about said electronic devices and identification information about said plug receptacles, and an output means that outputs information stored in said memory means.

A plug receptacle that supplies electricity to an electronic device connected to an interface unit, has a reception means that receives, from said interface unit, identification information about the connected electronic device, and a transmission means that transmits, to the connection wire to the power source side, connection information and identification information about said connected electronic device.

The plug receptacle may include a display unit and control means that controls said display unit based on signals received from a connection connected wire with the power source.

The adaptor may perform the above-described transmission at prescribed intervals.

A plug receptacle which supplies electricity to an electronic device connected to an interface unit may comprise:

reception means receiving from said interface unit, identification information about connected electronic devices;

memory means associating and storing said identification information and identification information about interface units that receive said identification information; and control means deciding whether identification information on an electronic device received from a connection wire connected to a power source in said memory means, and if it is stored, performs control so that connection destination information of said electronic devices received from said connection wire is similarly transmitted in correspondence with the respective electronic device connected to said interface unit.

BRIEF DESCRIPTION OF THE DRAWINGS

FIG. 5 shows a connection control table for controlling a connected electronic device of the system of FIG. 1;

FIG. 6 shows of a self-control table for storing identification information of plug receptacles and position information of an interface unit in the plug receptacle;

FIGS. 7A and 7B show two different arrangements respectively, of the interface units;

DETAILED DESCRIPTION OF THE PREFERRED EMBODIMENTS

Figure 1:
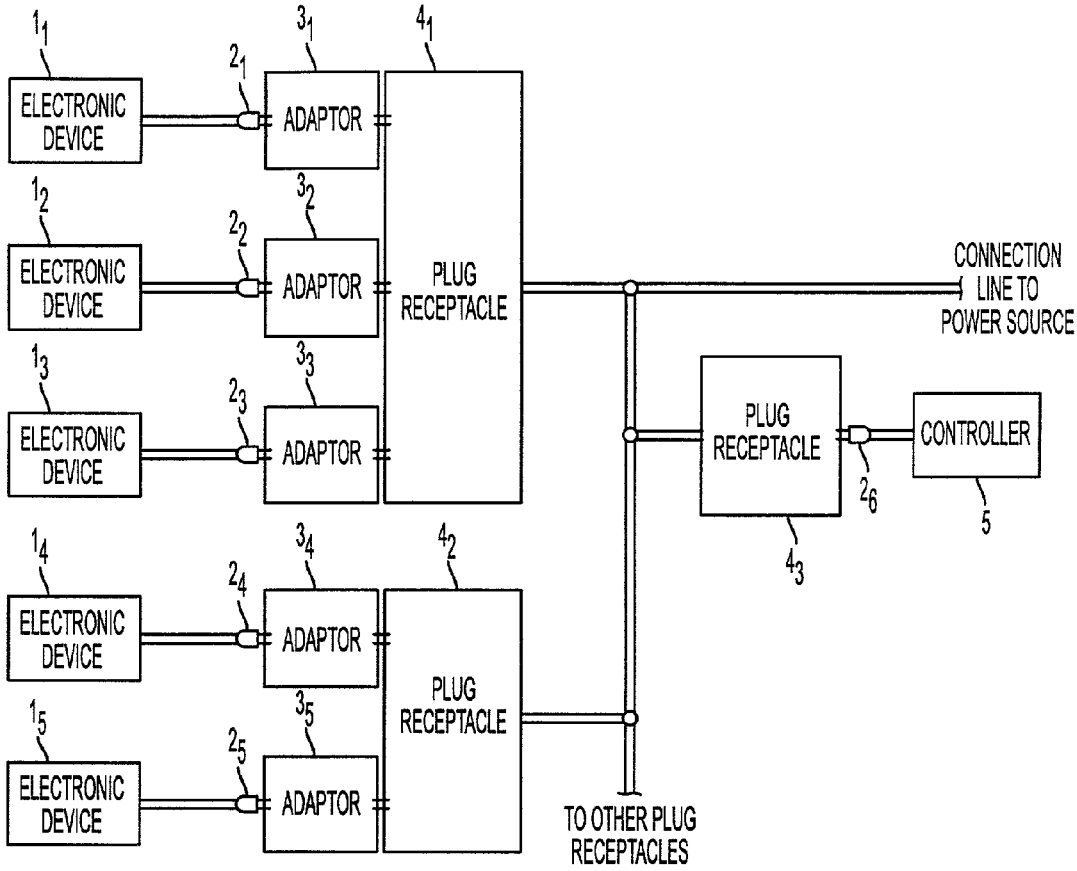
FIG. 1 diagrammatically shows the competition of an overall system of the present invention.

Referring now to FIG. 1, reference numeral 1 denotes various electronic devices subject to position control; the subscripts (1-5) are identification symbols that are appended to distinguish the various electronic devices (in the following, other subscripts are appended to distinguish one item from another in the same way). Examples of electronic devices are measurement devices, such as spectrum analyzers, for testing the performance of products, as well as household electronic devices used in a home.

Reference numeral 2 denotes a plug for making a plug receptacle connection with a connection wire for supplying electricity to the internal electronic circuitry of the electronic device 1; 3 denotes an adaptor attached to the plug of the electronic device, and electronic device 1 is supplied with electricity via the adaptor and the plug. Adaptor 3 may be built into the electronic device, but preferably one selects the adaptor that is detachable from the electronic device as a connection part (a part consisting of a connection wire and a plug), and it is desirable to provide the adaptor on the connection part. 4 denotes a plug receptacle for inserting a plug thereinto. A controller 5 that can be supplied with electricity and is connected either directly to a connection wire that makes the connection between the plug receptacle 4 and an AC power source, or to plug receptacle 4 via a plug as shown in the FIG. 1.

Next, the composition of the main elements of the system of the present invention will be described in detail.

Figure 2:
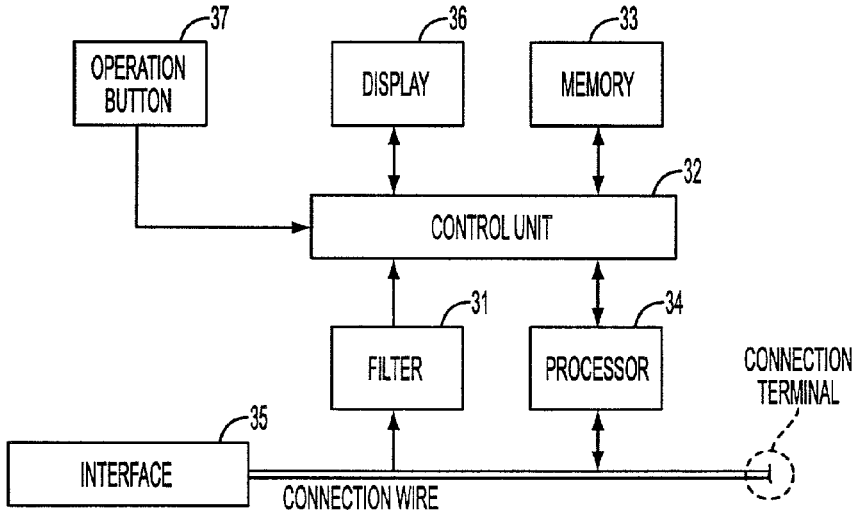
FIG. 2 is a block diagram of an adaptor of the system of FIG. 1.

FIG. 2 shows adaptor 3 in a block diagram. The adaptor include a filter 31 which is a filter that cuts off modulation superimposed on the connection wire by other adaptors and plug receptacles 4, and prevents modulation data from being input into the power source circuit (not shown) of a control unit 32 while power from the connection wire is supplied to control unit 32. The control unit 32 is operated by the power supplied through filter 31 and controls a memory 33, a transmission-reception processing unit 34, etc. Control unit 32 is also used as a detection means. Memory 33 stores identification information of the electronic device (for example, the name of the electronic device, the model number of the electronic device, its property number, etc.). This identification information specifies the electronic device to be connected as well as information about plug receptacle connection destination etc.

A transmission-reception processing unit 34 has the function of extracting the modulation data superimposed via the connection wire, demodulating it, performing modulation processing based on the reception function that gives demodulation data to control unit 32 and the data from control unit 32, generating signals of a sufficiently higher frequency than the frequency of the power that is supplied via the connection wire, and superimposing and transmitting them. Transmission-reception processing unit 34 and control unit 32 form a transmission means.

Adaptor 3 further includes an interface unit 35 which makes connections with a connection terminal such as plug 2 or adaptor 3 itself. Preferably, interface 35 includes the same kind of filter as filter 31 and has the function of cutting off the input to electronic device 1 of modulation data superimposed on the connection wire. A display unit 36 performs display under control of control unit 32, and an operation button 37 that has the function of detecting the button-pressing operation and reporting the detection to the control unit 32. Also, display unit 36 and control unit 32 are used as a display means, and operation button 37 used as an operation unit.

Figure 3:
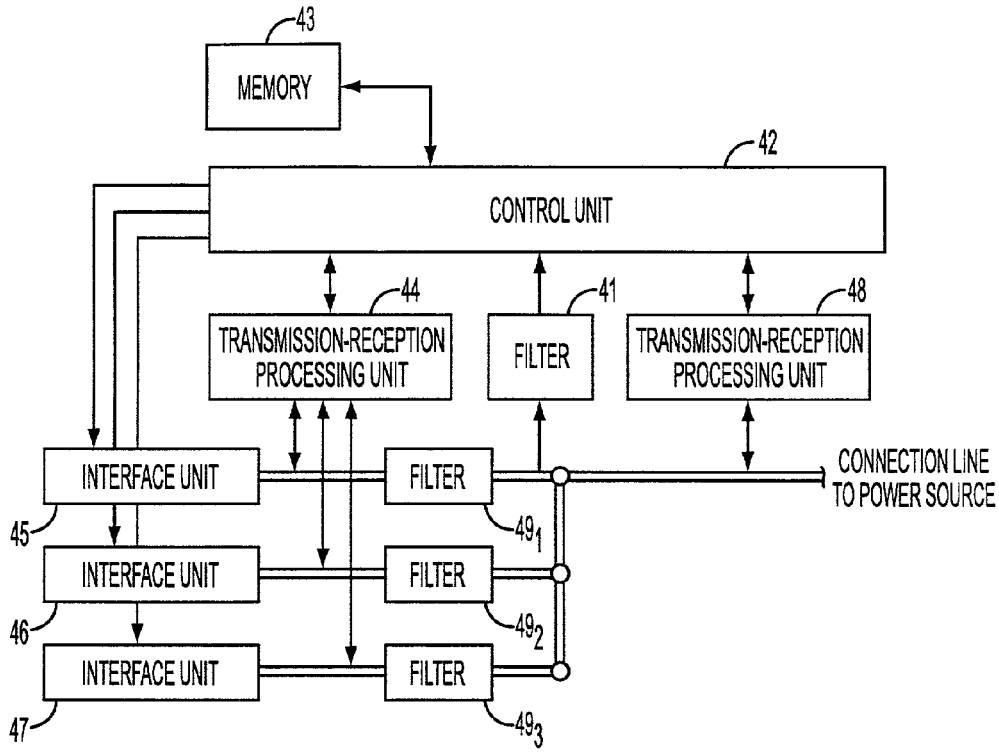
FIG. 3 is a block diagram of a plug receptacle of the system of FIG. 1.

FIG. 3 is a block diagram of the plug receptacle 4 which includes filters 41 and $\mathbf{49}_1$ through $\mathbf{49}_3$ which cut off the modulation data superimposed on the connection wire by adaptor 3, plug receptacle 4, controller 5, etc.; in particular, filter 41 is provided so that modulation data is not input into the power source circuit (not shown) of control unit 42 while power is supplied to control unit 42 from the connection wire.

Control unit 42 operates by the power supplied via filter 41 and controls a memory 43, transmission-reception processing units 44, 48, etc. Also, control unit 42 is as a control means. Memory 43 stores connection control tables, self-control data, etc. These will be described in detail later, but they record identification information about the connected electronic devices, identification information of plug receptacles, information about positions of plug receptacles on the interface unit (the arrangement relationship of interface units 45-47), etc.

44 and 48 are transmission-reception processing units which they have the function of extracting the modulation data superimposed via the connection wire, demodulating it, performing modulation processing based on the reception function that gives demodulation data to control unit 42 and the data from control unit 42, generating signals of a sufficiently higher frequency than the frequency of the power that is supplied via the connection wire, and superimposing and transmitting them. Also, transmission-reception processing unit 44 is used as a reception means. Transmission-reception processing unit 48 and control unit 42 are used as transmission means. Reference numerals 45-47 denote interface units which make connections with a connection terminal such as plug 2 or adaptor 3. Multiple interface units may be provided on a plug receptacle as shown in the diagram, and of course a single one may be provided as necessary.

With regard to plug receptacle $\mathbf{4}_3$ connected to controller 5 (as shown in FIG. 1), in FIG. 3 the plug receptacle is used that does not have a filter (for example, filter $\mathbf{49}_1$) provided on the connection wire with the power source side, and the plug receptacle connects controller 5 to an interface unit that does not have a filter (in this case, interface unit 45).

Figure 4:
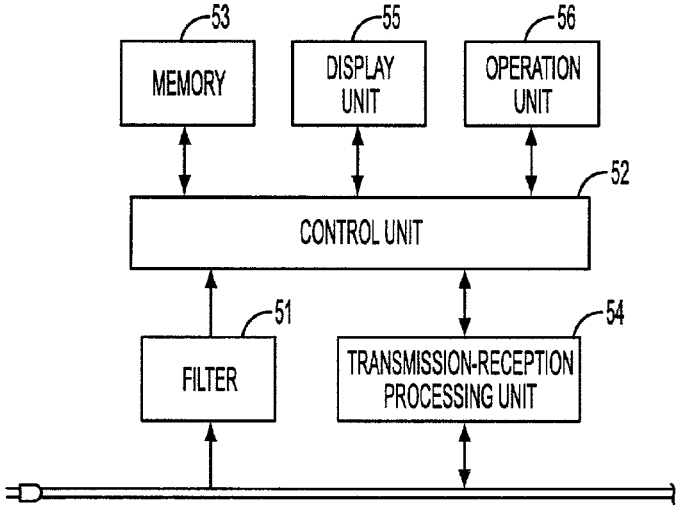
FIG. 4 is a block diagram of a controller of the system of FIG. 1.

FIG. 4 shows a block diagram of controller 5 which includes a filter 51 that cuts off modulation data superimposed on the connection wire by adaptor 3 and plug receptacle 4, and prevents modulation data from being input into the power source circuit (not pictured) of control unit 52 as power from the connection wire is supplied to control unit 52. The control unit 52 is operated by the power supplied through filter 51 and controls memory 53, transmission-reception processing unit 54, etc. Memory 53 stores control tables for electronic device 1, which will be described later, various information needed for position control, layout information on the buildings where electronic devices are installed, etc. The memory is used as a memory means. The transmission-reception processing unit 54; has the function of extracting the modulation data superimposed via the connection wire, demodulating it, performing modulation processing based on the reception function that gives demodulation data to control unit 52 and the data from control unit 52, generating signals of a sufficiently higher frequency than the frequency of the power that is supplied via the connection wire, and superimposing and transmitting them. Also, the transmission-reception processing unit is used as a reception means.

Controller 5 further includes a display unit 55 which corresponds to a display, etc. for displaying the control table and other information that is stored in memory 53. Also, display unit 55 and control unit 52 are used as output means. An operation unit 55 of controller 5 allows the operator of controller 5 to operate and control the controller 5, and it consists of a keyboard, etc.

Next, various embodiments concerning position control of electronic devices using the above-described system will be described.

<1> Position Control of Electronic Devices

If the electronic device 1 (for example, a dryer) can be freely taken out and used, then in order to recover the electronic device 1 that has been taken out, it is highly desirable to know as to where electronic device 1 is being used. In this working example, the basic position control method for an electronic device will be described.

Electronic device $\mathbf{1}_1$ has plug 2 for receiving a supply of electricity, and an adaptor $\mathbf{3}_1$ is mounted on this plug 2. It is assumed that as a general rule, electronic device $\mathbf{1}_1$ is moved with adaptor $\mathbf{3}_1$ mounted on plug $\mathbf{2}_1$. Here, it is further assumed that electronic device $\mathbf{1}_1$ (adaptor $\mathbf{3}_1$), after it has been moved, is connected to interface unit 45 of plug receptacle $\mathbf{4}_1$. In this state, control unit 32 of adaptor $\mathbf{3}_1$ mounted on electronic device $\mathbf{1}_1$ is operated by the supply of electricity from the connection wire via filter 31 (FIG. 2) and reads the electronic device identification information (for example, 01001) that is stored in memory 33 (for example, it suffices if it is stored by the initial setting of <3> describ below, or is input and stored by operation button 37). Here it is assumed that identification information of the electronic device indicates the type of the electronic device 1, and a dryer is indicated by 01001. Next, control unit 32 controls transmission-reception processing unit 34 so as to transmit identification information of the electronic device that has been read. Transmission-reception processing unit 34 diffuses the electronic device identification information by a diffusion code, then transmits it by generating signals of a sufficiently higher frequency than the frequency of the power that is supplied via the connection wire. Signals transmitted by adaptor $\mathbf{3}_1$ are input into plug receptacle $\mathbf{4}_1$ via interface unit 45. Transmission-reception processing unit 44 uses a filter to cut off the frequency of the power source and extracts the signals that are superimposed on the electric power that is supplied. Then it carries out demodulation by performing inverse diffusion processing, and gives the electronic device identification information to control unit 42. In giving the electronic device identification information to control unit 42, transmission-reception processing unit 44 also gives it the identification information on the interface unit that it received (for simplicity, identification information on interface units 45, 46, 47 has been denoted in FIG. 5 as 45, 46, 47, respectively).

Control unit 42, upon detecting the input of the electronic device identification information, registers it in the connection control table of memory 43.

The connection control table is shown in FIG. 5.

The connection control table is a table for controlling the connected electronic device identification information in correspondence with the interface units. In this example, control unit 32 recognizes by the signals given from aforesaid transmission-reception processing unit 34 that electronic device $\mathbf{1}_1$ is connected to interface unit 45, so electronic device identification information 01001 is stored in correspondence with interface unit identification information 45, as in FIG. 5.

Control unit 32 of plug receptacle $\mathbf{4}_1$ for which registration was made in the connection control table likewise reads, from the self-control data stored in memory 43, plug receptacle identification information (XXX), which is the identification information on itself (plug receptacle 4), plug receptacle position information (2F; ROOM03), and interface unit position information (1,1), and gives transmission-reception processing unit 48 position notice signals that include the information read from these, the received electronic device identification information (01001), and the interface unit identification information (45).

FIG. 6 shows a self-control table.

Plug receptacle identification information (XXX) is identification information that is arbitrarily assigned to each plug receptacle in order to perform identification of the plug receptacles controlled by controller 5. Plug receptacle position information (2F; ROOM) is information that can specify the position where plug receptacle $\mathbf{4}_1$ is provided; for example it is information on the floor number (2F) of the room in which the plug receptacle is provided, identification information on the room (ROOM003) in which the plug receptacle is provided, etc. Interface unit position information ((1,1) to (3,1)) is information that indicates the arrangement relationships of the interface units (45 to 47); if the interface units are arranged in matrix form, one can indicate by (M,N) that the interface is arranged in the M-th row and N-th column. For example, if an interface unit is arranged as in FIG. 7 (A), interface unit 45 is provided in the 1st row and 1st column, so its interface unit position information is (1,1). And if an interface unit is arranged as in FIG. 7 (B), interface unit P is provided in the 2nd row and 3rd column, so its interface unit position information is (2,3). Transmission-reception processing unit 48 modulates and transmits the position notice signals it has been given in the same way as transmission-reception processing unit 34 of adaptor 3. The signals transmitted by plug receptacle $\mathbf{4}_1$ are input into controller 5 via plug receptacle $\mathbf{4}_3$, plug $\mathbf{2}_6$, etc. Transmission-reception processing unit 54 of controller 5 uses a filter to cut off the power-source frequencies, and extracts the signals that were superimposed on the electric power that is supplied. Then, by performing inverse diffusion processing, it carries out demodulation and gives position notice signals to control unit 52. Control unit 52, upon detecting input of the position notice signals, performs registration in the position control table of memory 53. Control unit 52 operates while being supplied with electric power from which the signals superimposed by the plug receptacle, etc. have been removed by filter $\mathbf{5}_1$.

Figures 8, 9, 10, 11:
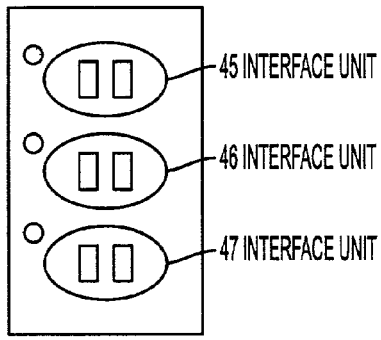
FIG. 8 shows a position control table provided for each plug receptacle, in a controller of the system of FIG. 1.
FIG. 9 shows the arrangement of the interface units with display units.
FIG. 10 shows the home control table which controls the home location of storages for electronic devices.
FIG. 11 shows a system construction table for storing a system type, identification information about multiple items of electronic identification information about interface units to be connected in the system.

FIG. 8 shows the position control table. A position control table is provided for each plug receptacle. Therefore, what is shown in the diagram is the position control table for plug receptacle $\mathbf{4}_1$ of identification information XXX. Position information about a plug receptacle is information for specifying the position where plug receptacle $\mathbf{4}_1$ is provided, in the same way as the plug receptacle position information in the self-control data of FIG. 6. The electronic device position information shows what kind of electronic device is connected to each interface unit. Therefore control unit 52, if it receives notice signals indicative of the preceding position, reads from memory 53 the position control table that corresponds to plug receptacle identification information XXX (or plug receptacle position information) included in the position notice signals, associates it with the plug receptacle unit identification information (45) (or interface unit position information (1,1)) included in the position notice signals, and registers electronic device identification information (010001) contained in the position notice signals, as in FIG. 8. Control unit 52 of controller 5 displays on the display region of display unit 55 the content of the position control table stored in memory 53, either automatically or upon a prescribed operation from operation unit 56.

For example, if electronic device identification information 01001 is input and an operation is made in which a search instruction is given, plug receptacle identification information XXX, plug receptacle position information 2FROOM003, interface unit identification information 45, interface unit position information (1,1), and other information of the tables in which 01001 is registered are displayed, so the operator of controller 5 will know which electronic devices are where.

As discussed above, if electronic device 1 is connected to a plug receptacle, one can keep track of its position.

However, if the plug is pulled out from the plug receptacle, the possibility becomes high that electronic device 1 is moving, and it sometimes happens that the position information on an electronic device in the position control table of controller 5 does not agree with its actual location. Thus, in this invention, the fact that electronic device 1 has been pulled out from the plug receptacle 4 is detected in controller 5.

The processing, etc. is the system of the present invention is described in the following:

As stated above, control unit 32 of adaptor 3 controls transmission-reception processing unit 34 and transmits electronic device identification information, and this transmission is done at least once within the prescribed time (T). Control unit 42 of plug receptacle 4, upon detecting that electronic device identification information has not been received for at least prescribed time T from electronic device 1 registered in the connection control table, controls transmission-reception processing unit 48 and causes it to transmit a non-connection notice signal including the electronic device identification information (here assumed to be 01001). Controller 5, upon receiving this non-connection notice signal by transmission-reception processing unit 54, deletes the electronic device identification information (01001) from the position control table. Therefore, from the fact that identification information about the position of the electronic device is non-registered (is deleted) even if the operator operates operation unit 56 so as to display the location of electronic device identification information 01001 on display unit 55, control unit 52 of controller 5 displays a change of messages such as "being moved", "not connected", etc.

Also, although in an example shown, electronic device identification information 01001 is deleted from the position control table upon receipt of a non-connection notice signal, one may also, without deleting it, cause information such as "being moved", "not connected", etc. to be stored and displayed in association with electronic device identification information 01001. And if operation unit 56 is operated so as to make a display of the final connection destination, it is desirable to display the position information (for example, "was connected to plug receptacle $\mathbf{4}_1$") that is stored without deleting it.

<2> Display of Destination to which Electronic Device is Moved

In <1>, there has been a description of keeping track of the locations of electronic devices, but next a working example of the case in which assistance is given for the work of moving an electronic device and connecting it to the prescribed plug receptacle will be described.

For example, if the operator of controller 5 assists the movement of electronic device $\mathbf{1}_1$, he operates operation unit 56 of controller 5 and inputs electronic device $\mathbf{1}_1$ identification information (for example, electronic device identification information 01001) and the plug receptacle identification information of the connection destination it is to be moved to (for example, XXX) (as well as, for example, interface unit identification information (45)).

The control unit 52 of controller 5 controls transmission-reception processing unit 54 so as to transmit movement notice signals including electronic device identification information 01001 and the designated plug receptacle identification information (interface unit identification information).

Transmission-reception processing unit 48 of each plug receptacle 4 connected to the connection wire receives movement notice signals, and control unit 42 decides whether the plug receptacle identification information (interface unit identification information) included in the movement notice signals is stored in the self-control data of its own memory 43. It executes control so as to flash the display units (for example, LEDs) that are provided corresponding to only a plug receptacle that is judged to be registered (that is, a plug receptacle where an electronic device is judged to be movement-connected to an interface under its own control), and an arbitrary interface unit among the interface units for which it is confirmed, by an arbitrary interface unit or by the connection control table, that no electronic device has been connected. Also, if an interface unit (for example, 45) is specified by the interface unit identification information, the display unit that corresponds to that interface unit (45) is flashed.

FIG. 9 shows the arrangement of interface units with display units under the control of control unit 42, the display unit (for example, LED) that is provided in correspondence to interface 45 is flashed, as shown in the diagram of FIG. 9 by a dark circle. Also, control unit 42 decides whether the electronic device identification information (01001) included in the movement notice signal that has been received is registered in the connection control table stored in memory 43. According to the decision, only if it decides it is registered does it execute control to the corresponding interface unit (45) so as to flash the display unit, and control transmission-reception processing unit 44 so as to transmit from the interface unit (45) a movement notice signal that contains the same information as the movement notice signal that was received. In this way, the display unit corresponding to the interface unit (45) flashes, and adaptor $\mathbf{3}_1$ receives the movement notice signal via transmission-reception processing unit 34 and displays on display unit 36 the movement destination plug receptacle identification information (interface unit identification information) that is included in the movement notice signal. Preferably, controller 5 transmits the plug receptacle position information (interface unit position information) of the movement connection destination to the movement notice signal along with the plug receptacle identification information (interface unit identification information) of the movement connection destination, and it is desirable that adaptor 3 display this position information on display unit 36.

The person who performs the work of moving electronic device 1 does not have much knowledge about the type of electronic device 1, and removes and carries out electronic device $\mathbf{1}_1$ connected to the interface unit 45 because the display unit corresponding to interface unit 45 on plug receptacle 4 is flashing. In doing so, a power source is no longer supplied to electronic device $\mathbf{1}_1$, but it is desirable to supply electric power and to continue the display of the plug receptacle identification information (plug receptacle position information, interface unit identification information, interface unit position information) in display unit 36 by supplying it to adaptor $\mathbf{3}_1$. In this way the operator knows where to take it to by looking at the information that is displayed on adaptor $\mathbf{3}_1$. And if he gets as far as the plug receptacle displayed on adaptor $3_1$, it suffices to connect the adaptor to the interface unit (45) that corresponds to the display unit that is flashing.

Also, if, by transmitting electronic device identification information to plug receptacle 4 from adaptor 3 in position control of the electronic device described above in <1>, plug receptacle $4_1$ designated as the connection destination plug receptacle by the movement notice signal, the electronic device identification information specified by the movement notice signal and the electronic device identification information from adaptor 3 similarly agree (preferably, if also the condition is met that the interface unit identification information specified by the movement notice signal and the interface unit that received the electronic device identification information from adaptor 3 agree), it is desirable to cause flashing by the display unit of the interface unit that had caused the flashing. Receiving such assistance, the operator can easily connect electronic device $1_1$ that he brought out, and connection errors are reduced.

<3> Initial Settings

Next, a method for making initial settings on the system of this working example will be described.

Specifically, there is described below the work of identification information on a of storing electronic device in memory 33 of adaptor 3 if adaptor 3 has not yet been attached to electronic device 1 and one newly purchases an adaptor 3.

First, in controller 5, one inputs multiple interface unit identification information (in this case, 45, 46, 47) and the electronic device identification information (01001, . . . , . . . ) that corresponds to each, and executes the operation of beginning initial settings processing. Then, control unit 52 of controller 5 is made to transmit this information to transmission-reception processing unit 54. Plug receptacle $4_1$ receives this information via transmission-reception processing unit 48 and stores it in memory 43 as initial settings information. In this state, newly purchased adaptors $3_1$ through $3_3$ are mounted on electronic devices $1_1$ through $1_3$, and are connected to interface units 45 through 47 of plug receptacle $4_1$. Then, a supply of electricity is received via filter 31, and control unit 32 of each electronic device $1_1$ through $1_3$ carries out the predetermined operation. That is, it generates a setting request signal and causes it to be transmitted to transmission-reception processing unit 34.

Control unit 42 of plug receptacle 4, upon receiving the setting request signal transmitted from transmission-reception processing unit 44 by adaptors $3_1$ through $3_3$, decides whether there is a match between the interface unit identification information received from controller 5 and stored in memory 43 and the interface that received the setting request signal. If it is decided that they agree, control unit 42 controls transmission-reception processing unit 44 so as to transmit to the matching interface unit a setting response signal that includes the electronic device identification information that is stored in memory 43 in correspondence with the interface unit identification information.

Control unit 32 of adaptor 3 receives the setting response signal via transmission-reception processing unit 34, acquires the electronic device identification information contained in it, and stores it in memory 33 as electronic device identification information of an electronic device on which it is mounted. Then control unit 32 controls transmission-reception processing unit 34 so as to transmit a setting completion signal to plug receptacle 4.

Transmission-reception processing unit 44 of plug receptacle 4 receives the setting completion signal via the interface unit, and among the initial settings information stored in memory 43, stores "setting completion" in correspondence to the interface identification information of the interface unit that performed this reception. When control unit 42 detects that setting completion has been stored for all the interface identification information contained in the initial settings information stored in memory 43, control unit 42 controls transmission-reception processing unit 48 so as to transmit a setting completion signal to controller 5. In controller 5, when control unit 52 receives a setting completion signal by transmission-reception processing unit 54, a setting completion message is displayed on display unit 55. Tis completes the initialization of electronic device identification information in adaptor 3 of each electronic device 1.

<4> Setting of Home Plug Receptacle

In such cases as when one carries out and uses each type of electronic device 1, then returns it to its original location, it is convenient to be able to easily recognize the original place to which each electronic device 1 should be returned. The processing of such cases is as follows:

First, in controller 5, one executes an operation that specifies whether it is electronic device identification information, plug receptacle identification information, interface unit identification information, etc. Then control unit 52 of controller 5 causes transmission-reception processing unit 54 to transmit a home registration signal that contains this information. Plug receptacle $4_1$ receives the home registration signal via transmission-reception processing unit 48 and makes the following decisions based on the various information included in the home registration signal.

If the home registration signal specifies by electronic device identification information an electronic device for which home registration is to be done, it decides whether to register the electronic device identification information in the connection control table of memory 43.

If the home registration signal specifies by plug receptacle identification information all the electronic devices connected to its plug receptacle, it decides whether to register one or more items of electronic device identification information in the connection control table of memory 43.

If the home registration signal specifies by interface unit identification information an electronic device that is connected to its interface unit, it refers to the connection control table of memory 43 and decides whether the electronic device is connected to the interface unit that is specified (whether the electronic device identification information has been registered).

Here, in the case of an affirmative decision, the home control table is generated and is stored in memory 43. The home control table is a table for controlling the position (home position) of, for example, the storage location of electronic devices, etc.; shown in the example of FIG. 10 is the case in which the interface unit is specified and the home position is specified. If one does not go so far as to specify the interface unit, it suffices simply to store the identification information of specified electronic devices as the home control table.

Control unit 42, which performs storage of the home control table, transmits a home notice signal that includes information about the connection destination of the plug receptacle (interface unit identification information of its interface unit 45, plug receptacle identification information XXX, plug receptacle position information 2F; ROOM03, interface unit position information (1,1)) with respect to interface unit 45, which corresponds to interface identification information specified by the home registration signal (if electronic device identification information is specified by the home registration signal, interface unit identification information that corresponds to the electronic device identification information, if plug receptacle identification information is specified by the home registration signal, all interface unit identification information that corresponds to electronic device identification information registered in the connection control table).

Control unit 32 of adaptor 3 receives the home notice signal via transmission-reception processing unit 34 and stores the various types of included information in memory 33 as its own home information. This completes home registration of adaptor 3. However, it is desirable that the home information stored in memory 33 be displayed on display unit 36 of adaptor 3, not shown, in the following cases:

At all times;

When it is detected that adaptor 3 has been pulled out of plug receptacle 4 (Control unit 32 can detect, for example, that a power source is no longer being supplied through filter 31. It is set up so that in that case adaptor 3 has a backup power source and operates by that power source.); and When the specified operation has been made on operation button 37

Of course, in these cases it is similarly desirable to flash the display unit that is provided in correspondence with the interface unit (preferably, display of the electronic device identification information stored in the home control table in correspondence with the interface unit identification information and in this case, it is necessary to have a liquid crystal display or other display unit that can display XXX)).

<5> System Construction

An embodiment will be now described, which forms a collection of multiple test devices (electronic devices) and includes communication devices and other test lines, manufacturing lines, etc.

First, the operator operates operation unit 56 of controller 5, creates a system construction table, and stores it in memory 53.

As shown for example in FIG. 11, the system construction table is a table in which are stored, for example, the system type (here, system A), multiple items of electronic device identification information that performs system construction (in the example of FIG. 11, 10011, 00111, 01011), and the associated interface unit identification information that specifies the interface units to be connected to, 45, 46, 47 in the example of FIG. 11.

One may also simply specify only identification information on the plug receptacle, without specifying the interface unit identification information, and store multiple items of electronic device identification information in correspondence with the plug receptacle identification information.

The control unit 52 controls transmission-reception processing unit 54 so as to transmit system registration signals that include interface unit identification information (or plug receptacle identification information) and electronic device identification information stored in the memory as system A.

Plug receptacle 4 receives a system registration signal from transmission-reception processing unit 48 and decides, by referring to the connection control table, whether the interface [unit] identification information is an interface unit that it has itself, and if it decides that it is an interface unit that it has itself, it stores the electronic device identification information in memory 43 as system A and causes the display units that correspond to interface units 45 through 47 that are specified by the interface unit identification information to flash.

Also, if plug receptacle identification information has been specified, similarly the electronic device identification information number specified by the system registration signal and the same number of interface unit display units are made to flash. If at this time it is detected, by reference to the connection control table, that no empty interface unit is available because an electronic device is connected that has not been registered in memory 43 as part of system A, it is desirable that control unit 42 perform control so that a message giving notice of this is transmitted to controller 5 from transmission-reception processing unit 48.

Control unit 42 of plug receptacle 4 also decides, separately, whether electronic device identification information that is not included in the system registration signal is stored in the connection control table of memory 43. If it decides that it is stored here, it transmits a system notice signal that contains the plug receptacle identification information (interface unit identification information) that is included in the system registration signal it has received, from the interface unit that is equivalent to the interface identification information that corresponds to its electronic device identification information, in the connection control table.

Adaptor 3 receives the system notice signal from transmission-reception processing unit 34. Control unit 32 stores the plug receptacle identification information (interface unit identification information) that is included in the system notice signal in memory 33 (preferably, it displays the information that is stored on display unit 36).

If control unit 42 of plug receptacle 4 detects that electronic device 1 is connected to a plug receptacle that is equivalent to a plug receptacle position prescribed by the operator in system A, it controls transmission-reception processing unit 48 so as to transmit to controller 5 a connection completion signal that contains electronic device identification information of electronic devices correctly connected.

This detection may also be executed as follows. Control unit 32 of adaptor 3 of each electronic device 1 controls transmission-reception processing unit 34 and periodically transmits its own electronic device identification information that is stored in memory 33. Therefore, for plug receptacle 4, when electronic device identification information is input from an interface unit that is causing its display unit to flash, it suffices to decide whether it matches the electronic device identification information stored in memory 43 as system A (if electronic device identification information and interface unit identification information are stored in association as system A, it is decided whether it has been received from an interface unit that is stored in association with the electronic device identification information), and if it does match, to decide that the above detection has been made. Preferably, if it does match, it is desirable to switch over from flashing to continuously lit for the display unit.

Control unit 52 of controller 5, upon receiving a connection completion signal concerning all electronic devices 1 specified in system A, displays a message of system construction completion on display unit 55. Also, for plug receptacle 4, it is desirable that said interface unit which had been flashing be turned off if it is detected that it has been connected for all electronic devices to be connected to itself that are designated by the system registration signal. By the foregoing, the electronic devices can be arranged correctly and it can easily be recognized that system construction has been completed.

In all the above working examples, it is necessary to prevent collisions of signals to be transmitted from multiple plug receptacles to controller 5 and signals to be transmitted from controller 5, but one can adopt various existing channel separation technologies, such as having each plug receptacle transmit by diffusing the transmission signal by a different diffusion code, separating them by frequency, separating them by time slots, etc.

EFFECTS OF THE INVENTION (1) In this invention, it is simple to mount an adaptor on an existing electronic device. Also, the electronic device can transmit its own identification information via the plug receptacle by means of this adaptor, position control of electronic devices is made easy.

(2) Due to this invention, information on connection destination of the electronic device is displayed on the display unit of the adaptor corresponding to the electronic device, making it easy to specify the storage locations, such as by setting a plug receptacle of the storage location as the connection destination. And because this display is made when the electronic device is removed from the plug receptacle, etc., the display can be done efficiently when electronic devices are moved.

(3) Because of this invention, the locations of electronic devices can be controlled so as to correspond with the locations of plug receptacles.

(4) Due to this invention, information (connection information) about the destination to which an electronic device is connected is transmitted on the connection wire with the power source in coordination with the identification information of the electronic device to which the plug receptacle is connected, so it is easy to manage the location control of electronic devices.

(5) In this invention, because control of display units provided on plug receptacles can be done by transmitting signals to the connection wire with the power source, the operator's attention can be drawn to a prescribed plug receptacle.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A plug receptacle that receives electricity from a connection wire connected with a power source and supplies electricity to an electronic device connected to an interface unit, said plug receptacle comprising:

a receiver receiving from said interface unit, identification information about the electronic device connected to the interface unit;

a transmitter transmitting through the connection wire toward a power source side of the plug receptacle, connection information and identification information about said electronic device;

a display unit integrally a part of said plug receptacle; and a controller controlling said display unit based on signals received from the connection wire connected with the power source.

2. A plug receptacle that supplies electricity to an electronic. device connected to an interface unit, said plug receptacle comprising:

a receptor that receives, from said interface unit, identification information of connected electronic devices; and a transmitter that transmits via connection wire to a side of a power source, identification information of said connected electronic devices, wherein said plug receptacle transmits connection information including self identification information, connected interface unit identification information, self position information, connected interface unit position information and other information that can specify connection destinations of electronic devices in correspondence with identification information of said electronic devices.

3. A plug receptacle that supplies electricity to an electronic device connected to an interface unit said plug receptacle comprising:

a receptor that receives, from said interface unit, identification information of connected electronic devices; and a transmitter that transmits via connection wire to a side of a power source, identification information of said connected electronic devices, wherein said plug receptacle transmits identification information about interface units to which said electronic devices are connected, in correspondence with identification information on said electronic devices.

4. A plug receptacle that receives electricity from a connection wire connected with a power source and supplies electricity to an electronic device connected to an interface unit, said plug receptacle comprising:

a display unit formed on a surface of said plug receptacle;

a demodulator operable to demodulate signals transmitted via the connection wire; and a controller operable to control said display unit based on a demodulated result obtained by the demodulator.

5. The plug receptacle as described in claim 4, wherein said display unit is provided corresponding to said interface unit, and said controller performs control of the display unit corresponding to said interface based on signals received from said connection wire.

6. A plug receptacle that supplies electricity to an electronic device connected to an interface unit, said plug receptacle comprising:

a receiver for receiving from said interface unit, identification information about connected electronic devices, a memory for associating and storing said identification information and identification information about interface units that receive said identification information; and a controller for deciding whether identification information of an electronic device, received from the connection wire with the power source, is stored in said memory, and if it is stored, for specifying the interface unit from the corresponding interface unit identification information and performing control of the display unit that corresponds to said interface unit.

7. The plug receptacle as described in claim 6, wherein said controller, upon detecting that said electronic device is connected to said specified interface unit, modifies the control of said display unit.

8. A plug receptacle that supplies electricity to an electronic device connected to an interface unit, said plug receptacle comprising:

a receiver receiving from said interface unit, identification information about connected electronic devices;

a memory associating and storing said identification information and identification information about interface units that receive said identification information; and a controller deciding whether identification information of an electronic device, received from a connection wire connected to a power source, is stored in said memory, and if it is stored, performs control so that connection destination information of said electronic devices received from said connection wire is similarly transmitted in correspondence with the respective electronic device connected to said interface unit.

9. A plug receptacle for tat supplies electricity to an electronic device connected to an interface unit, the plug receptacle comprising:

a receiver for receiving from said interface unit, identification information about connected electronic device; and a controller for deciding whether identification information received from a connection wire connected with a power source and said identification information about the connected electronic device match, and if they do match, performs control to transmit to said connection wire a signal indicating that the connection of said electronic device has been completed.

10. A plug receptacle that receives electricity from a connection wire connected with a power source and supplies electricity to an electronic device connected to an adaptor, said plug receptacle comprising:

a receiver receiving from said adaptor, identification information about the electronic device connected to the adaptor;

a transmitter transmitting through the connection wire toward a power source side of the plug receptacle, connection information and identification information about said electronic device;

a control unit controlling said receiver and transmitter; and a surface having an interface unit and a display, wherein said interface unit provides an electrical connection for said electrical device and said display controlled by the control unit.

11. The plug receptacle of claim 10, wherein said control unit controlling said display based on signals received from the connection wire.

12. The plug receptacle of claim 10, further comprising a memory controlled by said control unit and storing identification and position information.

* * * * *